US007047580B2

(12) United States Patent
Finn

(10) Patent No.: US 7,047,580 B2
(45) Date of Patent: May 23, 2006

(54) MULTI-LAYER MATTRESS PROTECTOR

(75) Inventor: Betsy Jean Finn, Countryside, IL (US)

(73) Assignee: Save Our Sleep, Inc., Countryside, IL (US)

( * ) Notice: Subject to any disclaimer, the term of this patent is extended or adjusted under 35 U.S.C. 154(b) by 0 days.

(21) Appl. No.: 11/056,694

(22) Filed: Feb. 11, 2005

(65) Prior Publication Data

US 2005/0177942 A1 Aug. 18, 2005

Related U.S. Application Data

(60) Provisional application No. 60/545,688, filed on Feb. 18, 2004.

(51) Int. Cl.
*A47G 9/02* (2006.01)

(52) U.S. Cl. ..... 5/502; 5/484; 5/486; 5/496

(58) Field of Classification Search ..... 5/484, 5/487, 488, 501, 502, 486, 496
See application file for complete search history.

(56) References Cited

U.S. PATENT DOCUMENTS

| | | | | | |
|---|---|---|---|---|---|
| 2,610,336 | A | | 9/1952 | Schworm | |
| 3,581,322 | A | | 6/1971 | Marsico | |
| 3,761,973 | A | * | 10/1973 | Leventhal | 5/484 |
| 4,388,738 | A | | 6/1983 | Wagner | |
| 4,809,375 | A | | 3/1989 | Bull | |
| 4,899,408 | A | * | 2/1990 | Illingworth | 5/484 |
| 4,922,565 | A | | 5/1990 | Blake | |
| 4,955,095 | A | | 9/1990 | Gerrick | |
| 5,003,655 | A | * | 4/1991 | Kafai | 5/496 |
| 5,086,530 | A | * | 2/1992 | Blake | 5/484 |
| 5,109,559 | A | | 5/1992 | West | |
| 5,566,411 | A | | 10/1996 | Eiler | |
| 6,009,579 | A | | 1/2000 | Pedersen | |
| 6,163,907 | A | | 12/2000 | Larson | |
| 6,233,762 | B1 | | 5/2001 | Bradley | |
| 6,490,741 | B1 | | 12/2002 | Wheeler | |
| 6,757,923 | B1 | * | 7/2004 | Sopher et al. | 5/496 |
| 6,859,962 | B1 | * | 3/2005 | Diak et al. | 5/499 |
| 2004/0128764 | A1 | * | 7/2004 | McGrath et al. | 5/499 |

OTHER PUBLICATIONS

PCT Internat'l Search Rpt, Nov. 16, 2005, Randolph Reese, 5 pages.
"The 'Ultimate Crib Sheet'?", "Epinions", Nov. 15, 2000, 2 pages, www.epinions.com.

* cited by examiner

*Primary Examiner*—Michael Trettel
(74) *Attorney, Agent, or Firm*—LeFevour Law Group, LLC; Martin LeFevour

(57) ABSTRACT

A multiple layer mattress protector is disclosed. The mattress protector utilizes, at least, two moisture proof layers with the top moisture proof layer being releasably attached to and removable from the bottom moisture proof layer. The top moisture proof layer may be easily removed from the mattress protector while someone is in the bed.

10 Claims, 3 Drawing Sheets

MULTI-LAYER MATTRESS PROTECTOR

CROSS-REFERENCE TO RELATED APPLICATION

This application claims the benefit of U.S. Provisional Application No. 60/545,688, entitled "Provisional Patent Application for 'save My Bed'" filed Feb. 18, 2004, which is incorporated herein by reference.

BACKGROUND

If a mattress is not protected, then when the mattress gets soiled, it may stain, and such stains can be very difficult, if not impossible, to remove. If such an unprotected mattress continues to be soiled and stained, it can generate a permanent odor that creates an unpleasant and unhealthy sleeping environment and, eventually, the mattress will become unusable and will need to be replaced. Mattresses are expensive, and to have to replace them prematurely due to soiling and staining becomes very costly.

Mattress pads have been around for a long time and are effective at helping protect a mattress from getting soiled or stained when a bedtime accident occurs (e.g. when a child wets his bed, when a child is sick in bed, when a person is incontinent and has a bedtime accident, etc.). However, such standard mattress pads can be inconvenient to use, cumbersome to deal with and difficult to change when most bedtime incidents occur—during the middle of the night. With a standard mattress pad, when an accident occurs during the middle of the night, the bed linens and mattress pad have to be removed and changed so the person in the bed can get back to sleep. Although the task of changing the bed linens and mattress pad may be quite simple and straight-forward during the day when no one is sleeping in the bed and there is no mess to clean up, it becomes a much more difficult and tedious task during the middle of the night when the caregiver or parent has been awoken from their sleep. First, the person sleeping in the bed has to be removed from the bed and, if necessary, cleaned up. If the sleeping person is elderly with limited mobility, this can be a very difficult and, possibly, messy task. Then, once the bed linens and mattress pad have been removed, the caregiver or parent has to remake the bed and get the person who had been sleeping in the bed back into bed.

Prior patents, such as U.S. Pat. No. 3,570,026 to Allison and U.S. Pat. Nos. 4,922,565 and 5,086,530 to Blake, disclose easily changeable top layers for use with cribs. However, such prior patents do not discuss or suggest using multiple moisture proof layers in a sheet assembly to provide continuing protection to the mattress, even after the top layer of the sheet assembly has been soiled and removed.

Accordingly, there is a need for a mattress protector that provides multiple layers of protection so that if a top moisture proof layer gets soiled, it can be easily removed, and the mattress protector will continue to protect the mattress while a user continues to use the mattress.

SUMMARY

In accordance with one aspect of the present invention, a multiple layer mattress protector includes a top moisture proof layer; a bottom moisture barrier assembly having an assembly retaining sidewall, a bottom moisture proof layer connected to the retaining sidewall and a non-scratchy surface layer disposed on top of the bottom moisture proof layer and a releasable fastener, wherein the releasable fastener releasably attaches the top moisture proof layer to the bottom moisture barrier assembly. The releasable fastener may be formed as a number of releasable fastener segments, where the releasable fastener segments may be zippers, snaps or hook and loop fasteners, such as Velcro® brand hook and loop fasteners. The top moisture proof layer and the bottom moisture barrier assembly of the mattress protector may be sized to fit a crib mattress. The bottom moisture proof layer and the non-scratchy surface layer may be constructed integral to one another.

According to another aspect of the present invention, a multiple layer mattress protector includes a top moisture proof layer having two long sides; a bottom moisture barrier assembly having two long sides and having an assembly retaining sidewall, a bottom moisture proof layer connected to the retaining sidewall and a non-scratchy surface layer disposed on top of the bottom moisture proof layer. The mattress protector also has a first zipper which is connected to one long side of the top moisture proof layer and also connected to one long side of the bottom moisture barrier assembly, and a second zipper connected to the other long side of the top moisture proof layer and also connected to the other long side of the bottom moisture barrier assembly; wherein the first and second zippers releasably attach the top moisture proof layer to the bottom moisture barrier assembly. The top moisture proof layer and the bottom moisture barrier assembly of the mattress protector may be sized to fit a crib mattress. The bottom moisture proof layer and the non-scratchy surface layer may be constructed integral to one another.

DESCRIPTION OF THE DRAWINGS

These and other features, aspects and advantages of the present invention will become better understood with regard to the following description, appended claims and accompanying drawings where:

DETAILED DESCRIPTION

Figure 1:
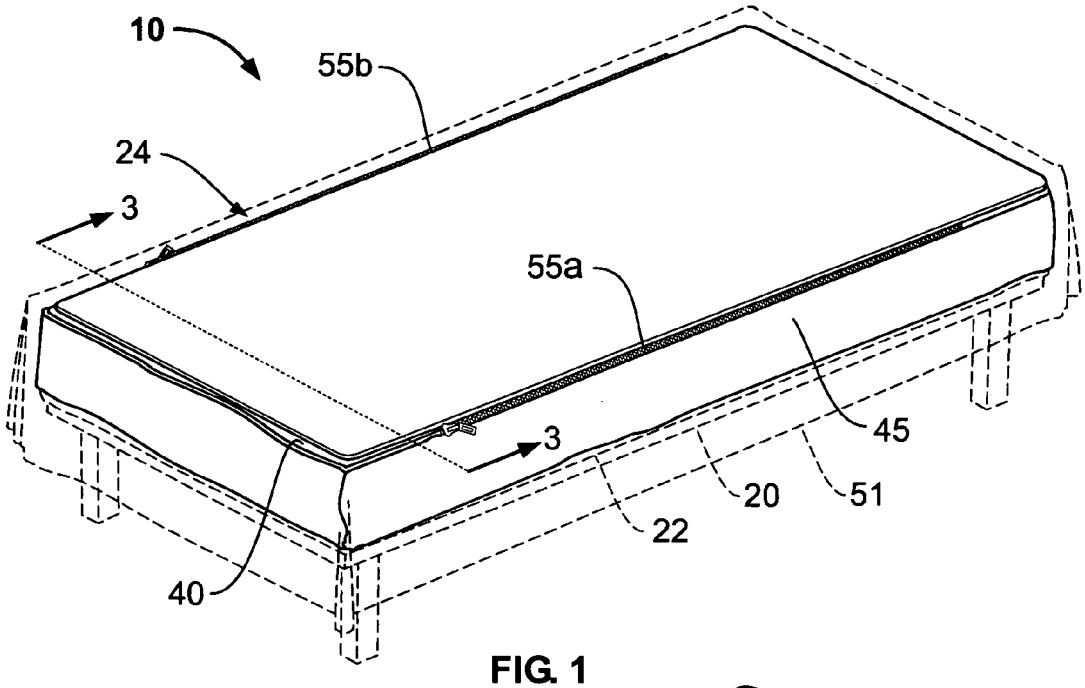
FIG. 1 is a perspective view of an embodiment of a mattress protector of the present invention shown in use with a mattress, a sheet and a bed frame.
Figure 2:
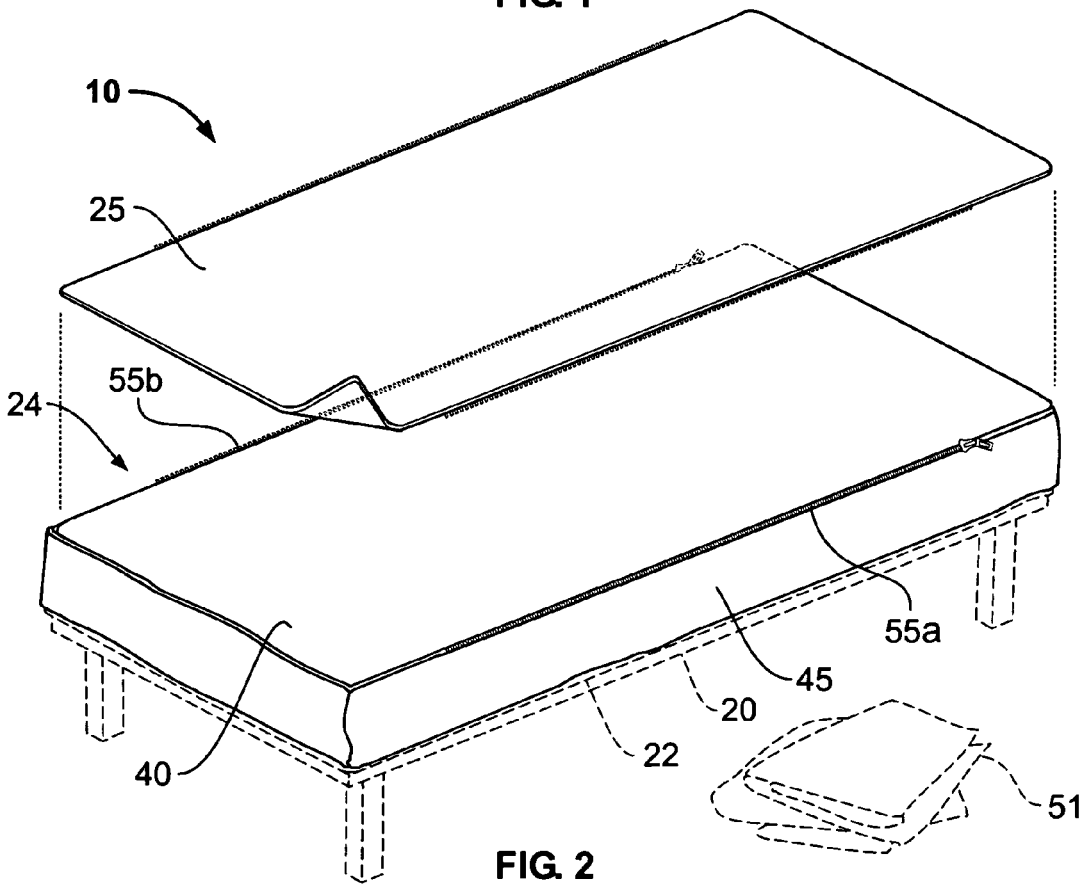
FIG. 2 is a view similar to FIG. 1 with the sheet removed and a top moisture proof layer of the mattress protector detached from and elevated over a bottom moisture barrier assembly of the mattress protector.
Figure 3:
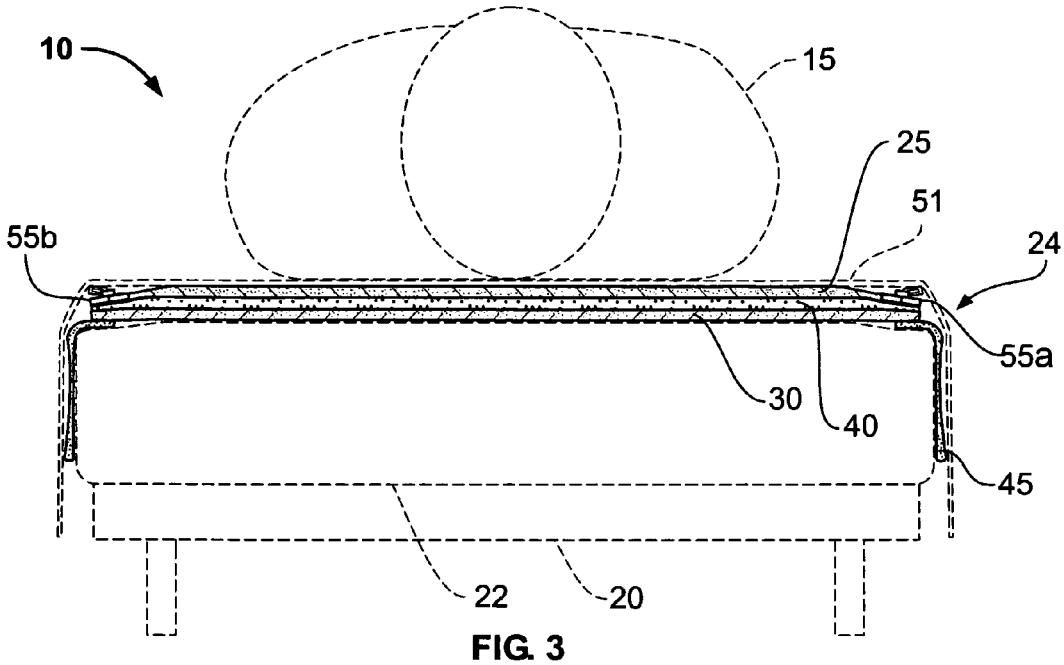
FIG. 3 is cross-sectional view taken along line 3—3 of FIG. 1.

Referring to FIGS. 1–3, an embodiment of a multiple layer mattress protector 10 of the present invention is depicted. The mattress protector 10 is shown disposed over a mattress 22 seated on a bed frame 20, and a sheet 51 is shown placed over the mattress protector 10. It should be understood that the mattress protector 10 of the present invention may be used with any size mattress 22. A user may place his own sheet 51 over the mattress protector 10. The mattress protector 10 of this embodiment includes a top moisture proof layer 25 and a bottom moisture barrier assembly 24. A pair of releasable fasteners 55*a*, 55*b* connects the top moisture proof layer 25 to the bottom moisture barrier assembly 24. In this embodiment, the releasable fasteners 55*a*, 55*b* are zippers, but it should be understood that other types of releasable fasteners may be employed as well (e.g. hook and loop type fasteners (e.g.,Velcro® brand hook and loop fasteners), snaps, etc.). Also, a pair of releasable fasteners 55*a*, 55*b* is shown, but it should be understood that a single releasable fastener or other variants of multiple fasteners could be employed as well.

In this embodiment, the bottom moisture barrier assembly 24 includes an assembly retaining sidewall 45, a non-scratchy surface layer 40 and a bottom moisture proof layer 30 (FIG. 3). The assembly retaining sidewall 45 in this embodiment is made of a stretchable, elastic material. To place the mattress protector 10 on the mattress 22, the sidewall 45 is stretched around and pulled down the sides of the mattress 22. The sidewall 45 holds the mattress protector 10 in place. In this embodiment, the bottom moisture proof layer 30 and the top moisture proof layer 25 are constructed of a soft pliable waterproof cotton-like material. It should be understood that both moisture proof layers 25, 30 may be constructed from any water proof material. It should also be understood that more than two moisture proof layers may be utilized. The invention is not limited to just the use of two moisture proof layers as described in this embodiment. In this embodiment, the non-scratchy surface layer 40 is a cotton sheet and provides a smooth, comfortable surface for a user of the mattress protector to sleep on. It should be understood that other materials or fabrics besides cotton may be used for the surface layer 40 and that although the surface layer 40 and the bottom moisture proof layer 30 are described as separate layers, it is conceivable that the two could be constructed integral with one another.

Figure 4:
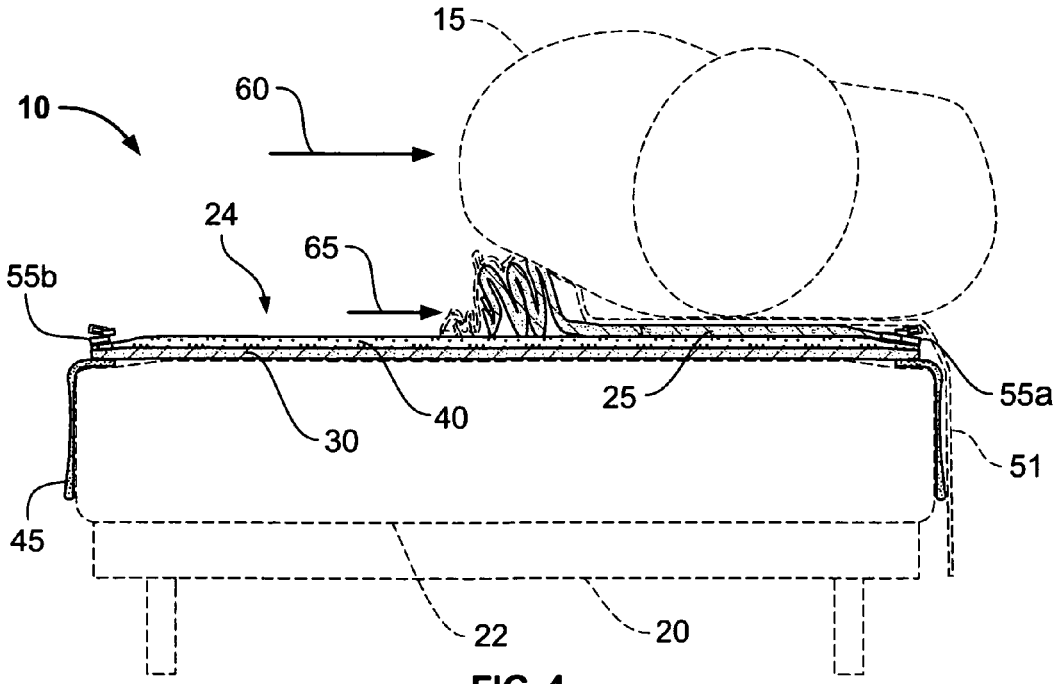
FIGS. 4 and 5 are views similar to FIG. 3 depicting the removal of the sheet and the top moisture proof layer.
Figure 5:
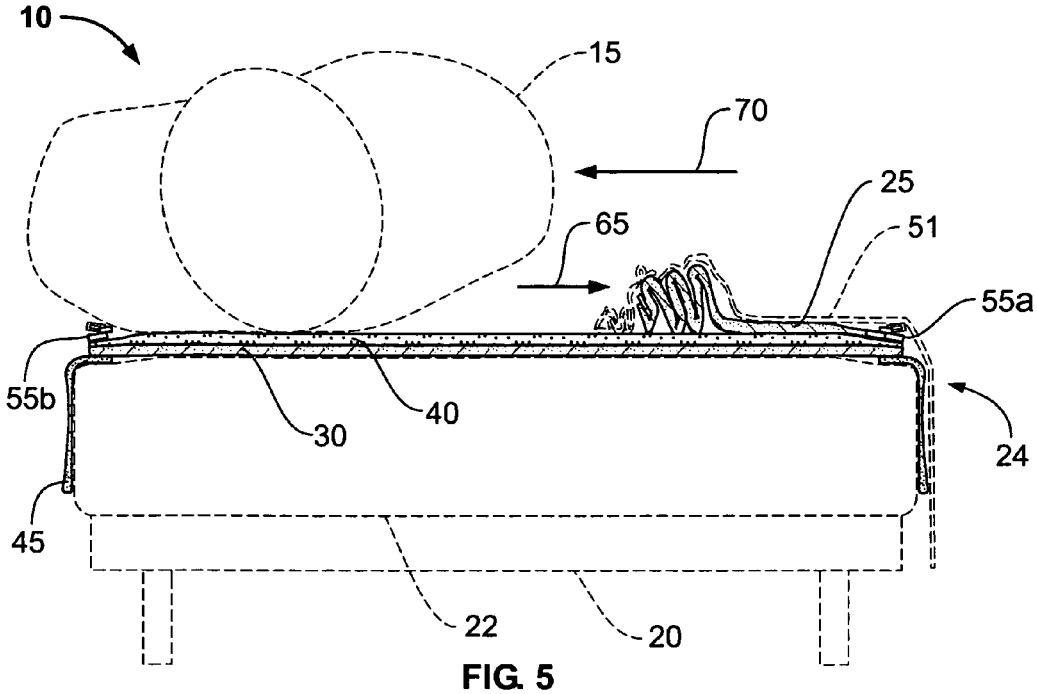
Figure 6:
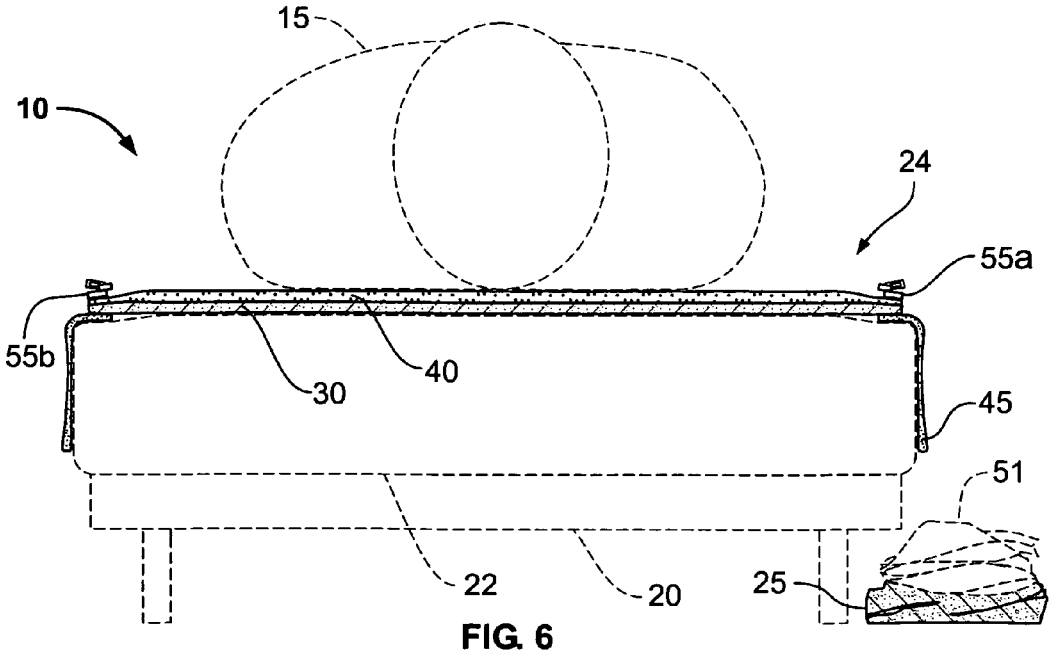
FIG. 6 is a view similar to FIG. 3 depicting the sheet, along with the top moisture proof layer of the mattress protector, removed.

Referring to FIGS. 3–6, the mattress protector 10 is shown in use. In FIG. 3, the bed is made up with the mattress protector 10 on the mattress 22 and a sheet 5 1 covering the mattress protector 10. A person 15 is shown lying on the mattress 22. Though not shown, but as is typical, another sheet, as well as a blanket, could be placed on top of the person 15. Referring to FIG. 4, the person 15 has soiled the bed in some fashion, and the caregiver is taking off the top soiled sheet 51 and top moisture proof layer 25 without needing to remove the person 15 from the bed. Although, the person 15 is still depicted as being in the bed when the sheet 51 and the top moisture proof layer 25 are removed, it should be understood that the caregiver could obviously remove the person 15 from the bed as well if desired. To remove the top moisture proof layer 25, the caregiver unzips the fastener 55*b* and, while rotating the person 15 upward as arrow 60 depicts, pushes the top moisture proof layer 25, along with the sheet 51, under the person 15 as arrow 65 depicts. Then, referring to FIG. 5, the caregiver rotates the person 15 in the other direction as arrow 70 depicts and continues to move the sheet 51 and the top moisture layer 25 towards the other edge of the mattress 22 as arrow 65 depicts. The caregiver can then unzip the other fastener 55*a* on the other side of the top moisture layer 25 to disconnect the soiled top moisture layer 25 from the bottom moisture barrier assembly 24. As shown in FIG. 6, the person 15 can be set back down on the top non-scratchy surface layer 40 of the mattress protector 10 and can continue sleeping. The mattress 22 is still protected by bottom moisture proof layer 30. The caregiver did not have to re-make the entire bed. The soiled sheet 51 and the top moisture layer 25 have been removed and may be laundered when convenient for the caregiver, allowing the caregiver to go back to sleep as well, if desired.

In another embodiment, the mattress 22 may be a crib mattress, and the releasable fasteners 55*a*, 55*b* of the mattress protector 10 may be snaps instead of zippers. In such an embodiment, when the sheet 51 and the top moisture proof layer 25 are soiled, the top moisture proof layer 25 may be easily removed by the parent while still attending to the child. The parent may hold the child in one hand and unsnap the snaps 55*a*, 55*b* to remove the top moisture proof layer 25 from the bottom moisture barrier assembly 24.

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

What is claimed is:

1. A multiple layer mattress protector, comprising:

a reusable top moisture proof layer;

a bottom moisture barrier assembly, having an assembly retaining sidewall, a bottom moisture proof layer connected to the retaining sidewall and a non-scratchy surface layer disposed on top of and connected to the bottom moisture proof layer; and a releasable fastener, wherein, in multiple uses, the releasable fastener releasably attaches and detaches the top moisture proof layer to and from the bottom moisture barrier assembly.

2. The multiple layer mattress protector of claim 1, wherein the releasable fastener comprises a plurality of releasable fastener segments.

3. The multiple layer mattress protector of claim 2, wherein the releasable fastener segments are zippers.

4. The multiple layer mattress protector of claim 2, wherein the releasable fastener segments are snaps.

5. The multiple layer mattress protector of claim 2, wherein the releasable fastener segments are hook and loop fasteners.

6. The multiple layer mattress protector of claim 1, wherein the reusable top moisture proof layer and the bottom moisture barrier assembly are sized to fit a crib mattress.

7. The multiple layer mattress protector of claim 1, wherein the bottom moisture proof layer and the non-scratchy surface layer are constructed integral to one another.

8. A multiple layer mattress protector, comprising:

a reusable top moisture proof layer having two long sides;

a bottom moisture barrier assembly having two long sides and having an assembly retaining sidewall, a bottom moisture proof layer connected to the retaining sidewall and a non-scratchy surface layer disposed on top of and connected to the bottom moisture proof layer;

a first zipper connected to one long side of the reusable top moisture proof layer and also connected to one long side of the bottom moisture barrier assembly; and a second zipper connected to the other long side of the reusable top moisture proof layer and also connected to the other long side of the bottom moisture barrier assembly; wherein, in multiple uses, the first and second zippers releasably attach and detach the top moisture proof layer to and from the bottom moisture barrier assembly.

9. The multiple layer mattress protector of claim 8, wherein the reusable top moisture proof layer and the bottom moisture barrier assembly are sized to fit a crib mattress.

10. The multiple layer mattress protector of claim 8, wherein the bottom moisture proof layer and the non-scratchy surface layer are constructed integral to one another.

* * * * *